US008196331B2

(12) United States Patent
Chen et al.

(10) Patent No.: US 8,196,331 B2
(45) Date of Patent: Jun. 12, 2012

(54) AUTO LIGHT INTENSITY ADJUSTMENT SYSTEM

(75) Inventors: Tung-Ching Chen, Taichung (TW); Shang-Yung Liang, Taichung (TW)

(73) Assignee: Asia Optical Co., Inc., Tepz, Taichung (TW)

( * ) Notice: Subject to any disclaimer, the term of this patent is extended or adjusted under 35 U.S.C. 154(b) by 352 days.

(21) Appl. No.: 12/555,079

(22) Filed: Sep. 8, 2009

(65) Prior Publication Data

US 2010/0083555 A1 Apr. 8, 2010

(30) Foreign Application Priority Data

Oct. 2, 2008 (TW) ..... 97137941 A

(51) Int. Cl.
*F41G 1/12* (2006.01)

(52) U.S. Cl. ..... 42/123; 42/131

(58) Field of Classification Search ..... 42/123, 42/131

See application file for complete search history.

(56) References Cited

U.S. PATENT DOCUMENTS 6,327,806 B1 * 12/2001 Paige ..... 42/113
2003/0086165 A1 * 5/2003 Cross et al. ..... 359/424
2006/0048432 A1 * 3/2006 Staley ..... 42/122

* cited by examiner

*Primary Examiner* — Stephen M Johnson
(74) *Attorney, Agent, or Firm* — Thomas|Kayden

(57) ABSTRACT

An auto light intensity adjustment system is provided. The auto light intensity adjustment system includes a light sensing unit, a charge/discharge circuit, a comparator unit and a light source module. The light sensing unit outputs a sensing signal according to an ambient light intensity detected thereby. The charge/discharge circuit is coupled to the light sensing unit for receiving the sensing signal, and generating a voltage signal with regular variation periods according to the sensing signal. The comparator unit compares the voltage signal to a threshold value signal, and outputs a result signal accordingly. The light source module modifies a light intensity according to the result signal. The invention automatically controls the light intensity according to the ambient light intensity.

10 Claims, 9 Drawing Sheets

AUTO LIGHT INTENSITY ADJUSTMENT SYSTEM

CROSS REFERENCE TO RELATED APPLICATIONS

This application claims priority of Taiwan Patent Application No. 097137941, filed on Oct. 2, 2008, the entirety of which is incorporated by reference herein.

BACKGROUND OF THE INVENTION

1. Field of the Invention

The present invention relates to an auto light intensity adjustment system, and in particular relates to an auto light intensity adjustment system utilized on an aiming device.

2. Description of the Related Art

FIGS. 1 and 2 show a conventional aiming device disposed on a gun. The aiming device comprises an outer tube 1, an objective lens unit 2 disposed on a front end of the outer tube 1, an eyepiece unit 3 disposed on a rear end of the outer tube 1, a multiplier unit 4, two impact point compensation units 5 for compensating for deviation and an aiming unit 6. The aiming unit 6 comprises an aiming sheet 61 and a light source 62. The aiming sheet 61 is disposed on a rear end of an inner tube 401. The aiming sheet 61 comprises a hairline portion 611 for aiming. The light source 62 comprises a fixing base 621 disposed on the rear end of the outer tube 1, a variable resistor 622 disposed in the fixing base 621, a circuit board 623 disposed in the fixing base 621, a battery bearer 624 disposed on the fixing base 621, a battery 625 disposed in the battery bearer 624, an operation ring 626 disposed on the battery bearer 624, a seal cover 627 sealing the battery bearer 624, a refractive ring 628 disposed in the outer tube 1 behind the aiming sheet 61, and an LED element 629 disposed on the refractive ring 628.

When a user aims and shoots the gun in a bright environment at a target, the user rotates the operation ring 626 to increase light intensity of an LED element. The light of the LED element 629 is refracted by the refractive ring 628 to the hairline portion 611 of the aiming sheet, and the hairline portion 611 reflects the light to form a illuminated aiming mark. Therefore, the user is allowed to aim with a brighter hairline portion 611 under a bright environment. However, when the target moves from a darker to a brighter environment, the user must manually increase brightness of the aiming mark to show the aiming mark clearly on an aiming window. In this situation, the user must stop aiming at the target and view and rotate the operation ring 626 to adjust the intensity of the light. Thus, during the time of the adjustment, the target may disappear. As such, shortcomings exist with the light intensity adjustment method of conventional aiming devices.

BRIEF SUMMARY OF THE INVENTION

The invention provides a circuit which controls the light intensity of a target mark according to an ambient light intensity, thus solving the shortcomings mentioned above.

An auto light intensity adjustment system is provided. The auto light intensity adjustment system comprises a light sensing unit, a charge/discharge circuit, a comparator unit and a light source module. The light sensing unit outputs a sensing signal according to an ambient light intensity detected thereby. The charge/discharge circuit is coupled to the light sensing unit for receiving a sensing signal, and generating a voltage signal with regular variation periods according to the sensing signal. The comparator unit compares the voltage signal to a threshold value signal, and outputs a result signal accordingly. The light source module modifies a lighting intensity according to the result signal.

In another embodiment, an aiming device is provided. The aiming device comprises an auto light intensity adjustment system, power source and a target marking portion. The auto light intensity adjustment system modifies a lighting intensity according to an ambient light intensity detected thereby. The power source provides power to the auto light intensity adjustment system. The target marking portion comprises a target mark, wherein the target mark is illuminated by a light emitted from the auto light intensity adjustment system.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
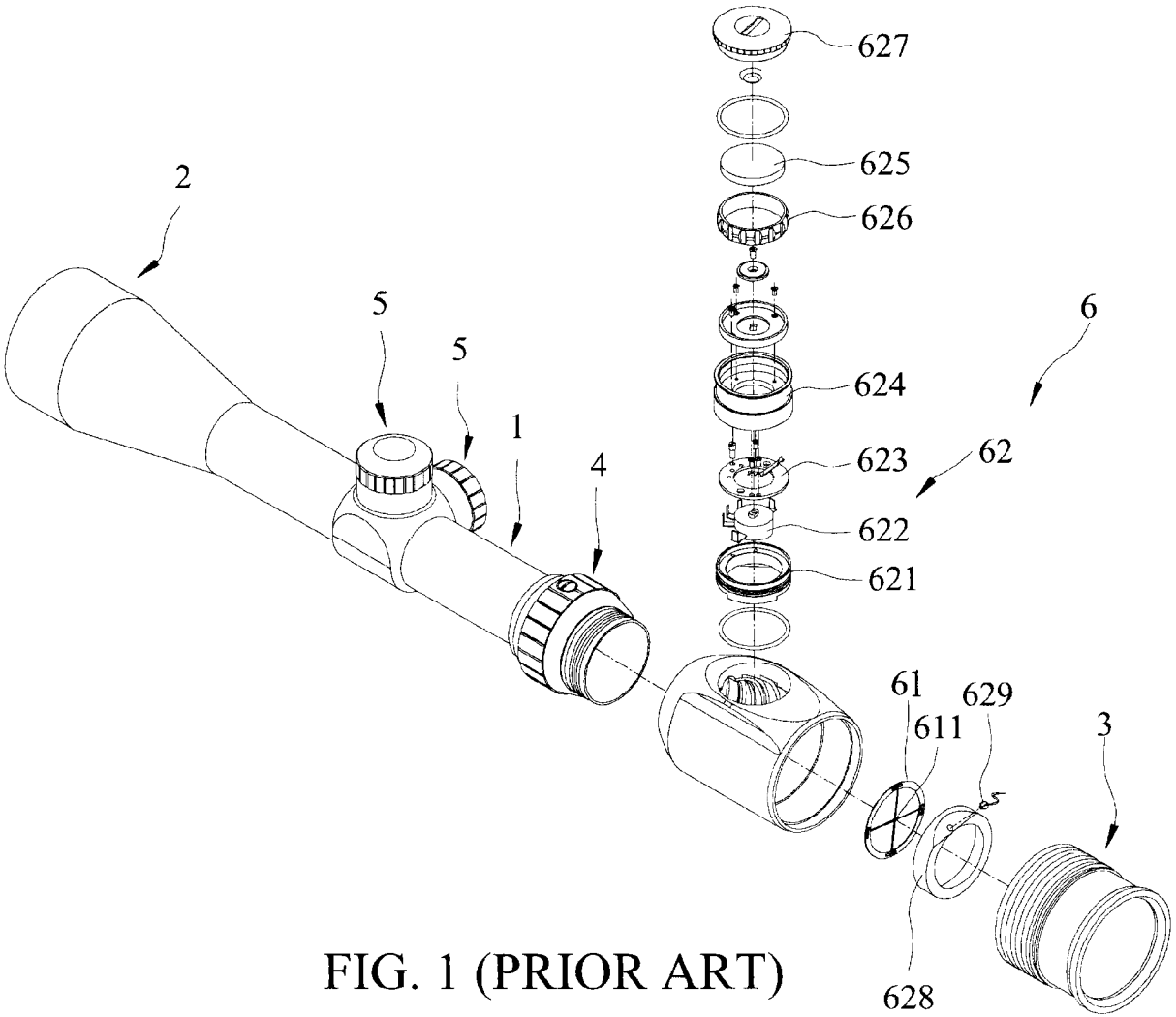
FIG. 1 (PRIOR ART)
FIGS. 1 and 2 show a conventional aiming device disposed on a gun.
Figure 2:
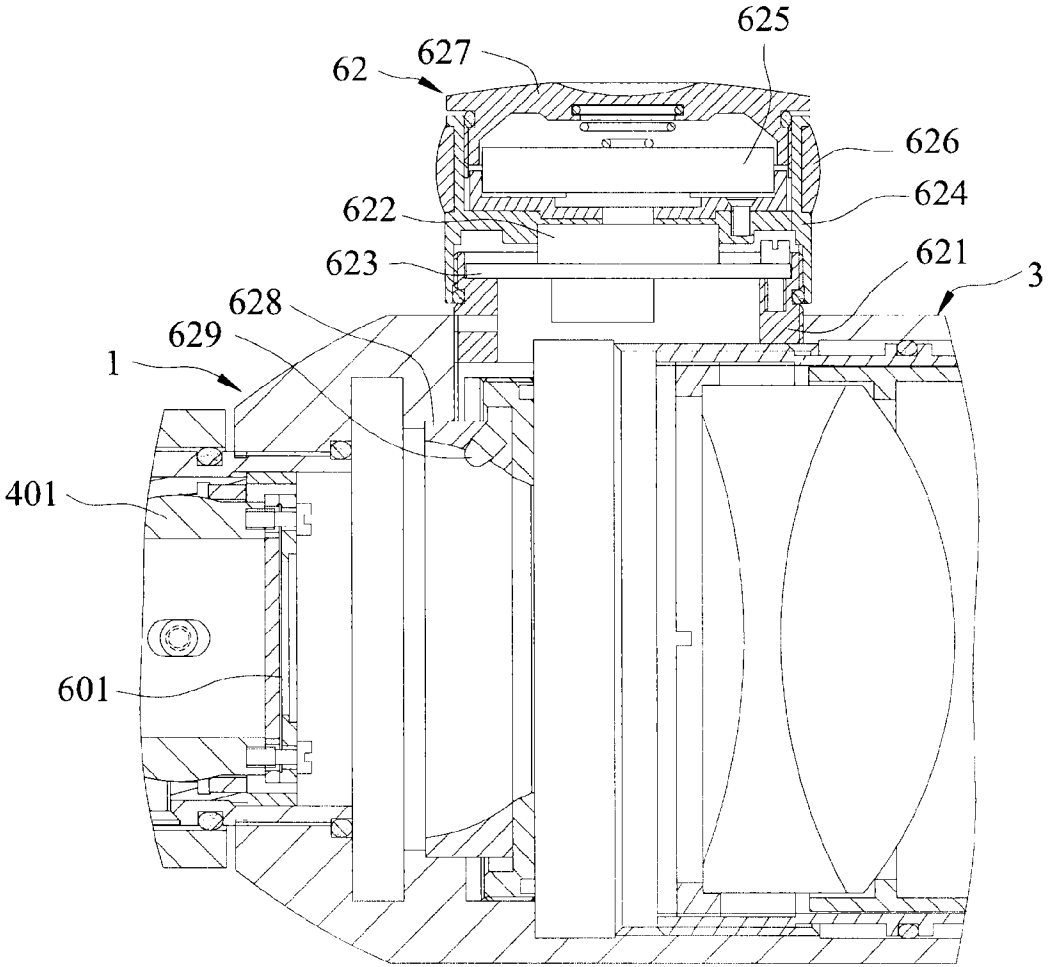
FIG. 2 (PRIOR ART)
Figure 3:
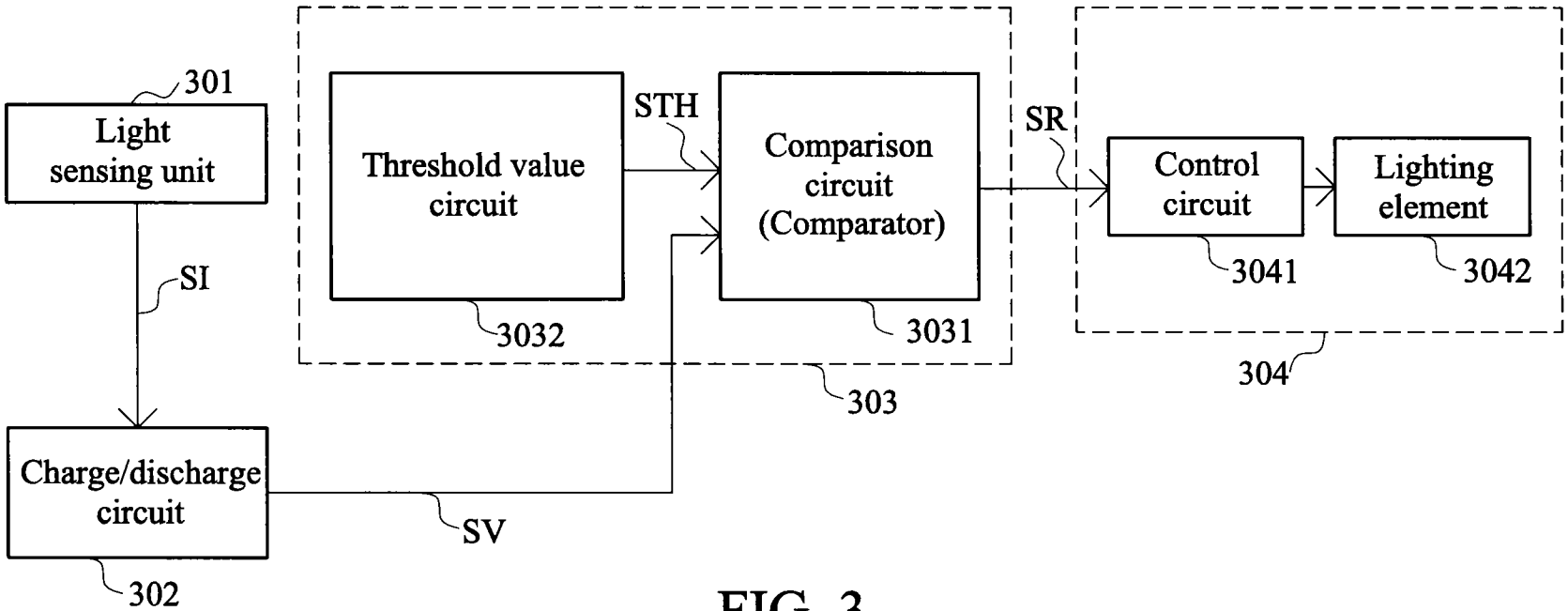
FIG. 3 is a block diagram of an auto light intensity adjustment system 30 of an embodiment of the invention.

FIG. 3 is a block diagram of an auto light intensity adjustment system 30 of an embodiment of the invention, comprising a light sensing unit 301, a charge/discharge circuit 302, a comparator unit 303 and a light source module 304.

Figure 4:
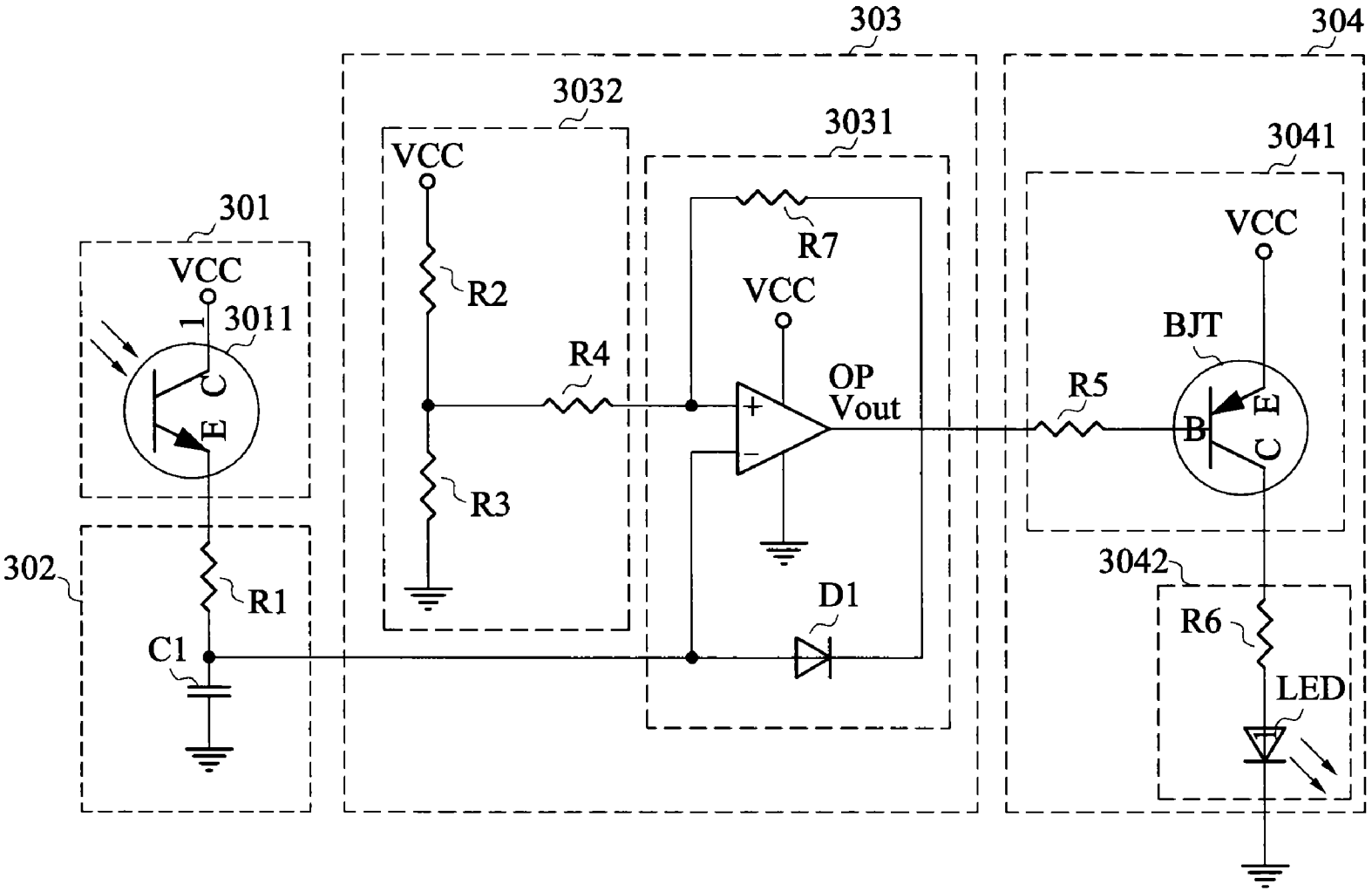
FIG. 4 is circuit diagram of an embodiment of the invention.

FIG. 4 is circuit diagram of an embodiment of the invention.

The light sensing unit 301 outputs a sensing signal SI according to an ambient light intensity sensed thereby. In the embodiment, the light sensing unit 301 comprises a light sensor 3011 comprising a collector and an emitter. The collector is coupled to power source VCC. According to the ambient light intensity detected, the emitter outputs the sensing signal SI. The sensing signal SI is a current signal. When the ambient light intensity is increased, the current signal outputted from the emitter is increased. When the ambient light intensity is decreased, the current signal outputted from the emitter is decreased.

The charge/discharge circuit 302 is coupled to the light sensing unit 301 for receiving the sensing signal SI therefrom, and generating a voltage signal SV with regular variation periods in accordance with the amplitude of sensing signal passing through the resistor. In the embodiment of the invention, the charge/discharge circuit is an RC circuit, comprising a first resistor R1 and a first capacitor C1. The first resistor R1 is coupled to the emitter of the light sensor 3011 and the first capacitor C1. The other terminal of the first capacitor R1 is grounded. Therefore, after the current signal passes the first resistor R1, electric charges are stored in the first capacitor C1, and the first capacitor C1 provides predetermined period changes of the voltage signal SV. When the input current is constant, the predetermined period can be adjusted by changing the parameters of the first resistor R1 and the first capacitor C1. Similarly, when the parameters of the first resistor R1 and the first capacitor C1 are constant, the predetermined period can be adjusted by changing the input current. The predetermined period is a charging time required by the first capacitor C1 for reaching a saturation voltage. The ambient light intensity sensed by the light sensor 3011 effects the charging time required by the first capacitor C1. For example, when the input current signal is increased, the charging time required by the first capacitor C1 is reduced. When the input current signal is decreased, the charging time required by the first capacitor C1 is increased.

The comparator unit 303 outputs a result signal SR according to the voltage signal SV. The comparator unit 303 comprises a comparison circuit 3031 and a threshold value circuit 3032. The comparison circuit 3031 compares the voltage signal SV to the threshold value signal STH outputted from the threshold value circuit 3032, and outputs the result signal SR. In the embodiment, the comparison circuit 3031 comprises an amplifier OP, a seventh resistor R7 and a first diode D1. The amplifier OP has a threshold value input terminal (+) coupled to the threshold value circuit 3032 for receiving the threshold value signal STH, a signal input terminal (−) coupled to the first capacitor C1 of the charge/discharge circuit 302 for receiving the voltage signal SV, and a signal output terminal (Vout) for outputting the result signal SR according to the comparison result of the comparator 3031.

The threshold value circuit 3032 is a voltage divider circuit comprising a second resistor R2, a third resistor R3 and a fourth resistor R4. The threshold value circuit 3032 divides the power source VCC into the threshold value signal STH. The threshold value signal STH is a threshold value voltage.

The light source module 304 comprises a control circuit 3041 and a lighting element 3042. The control circuit 3041 controls an enable frequency of the lighting element 3042 according to the result signal SR to control the lighting intensity of the lighting element 3042. In the embodiment, the control circuit 3041 comprises a PNP transistor BJT and a fifth resistor R5. The emitter of the transistor BJT is coupled to the power source (VCC), the base thereof is coupled to the voltage output terminal (Vout) via the fifth resistor R5, and the collector thereof is coupled to the lighting element 3042 via a sixth resistor R6. The voltage level of the result signal SR inputted to the transistor BJT can control the emitter connected or disconnected to the base.

The lighting element 3042 comprises a light emitting diode LED and a sixth resistor R6. When a high level voltage is input to the base of the transistor BJT, the emitter disconnect from the collector and no power is applied to the light emitting diode, thus, the lighting element 3042 is disabled. When a low level voltage is input to the base of the transistor BJT, the emitter connects to the collector and power is applied to the light emitting diode, thus, the lighting element 3042 is enabled.

The operating system under different environment light intensities is described as follows.

Figure 5A:
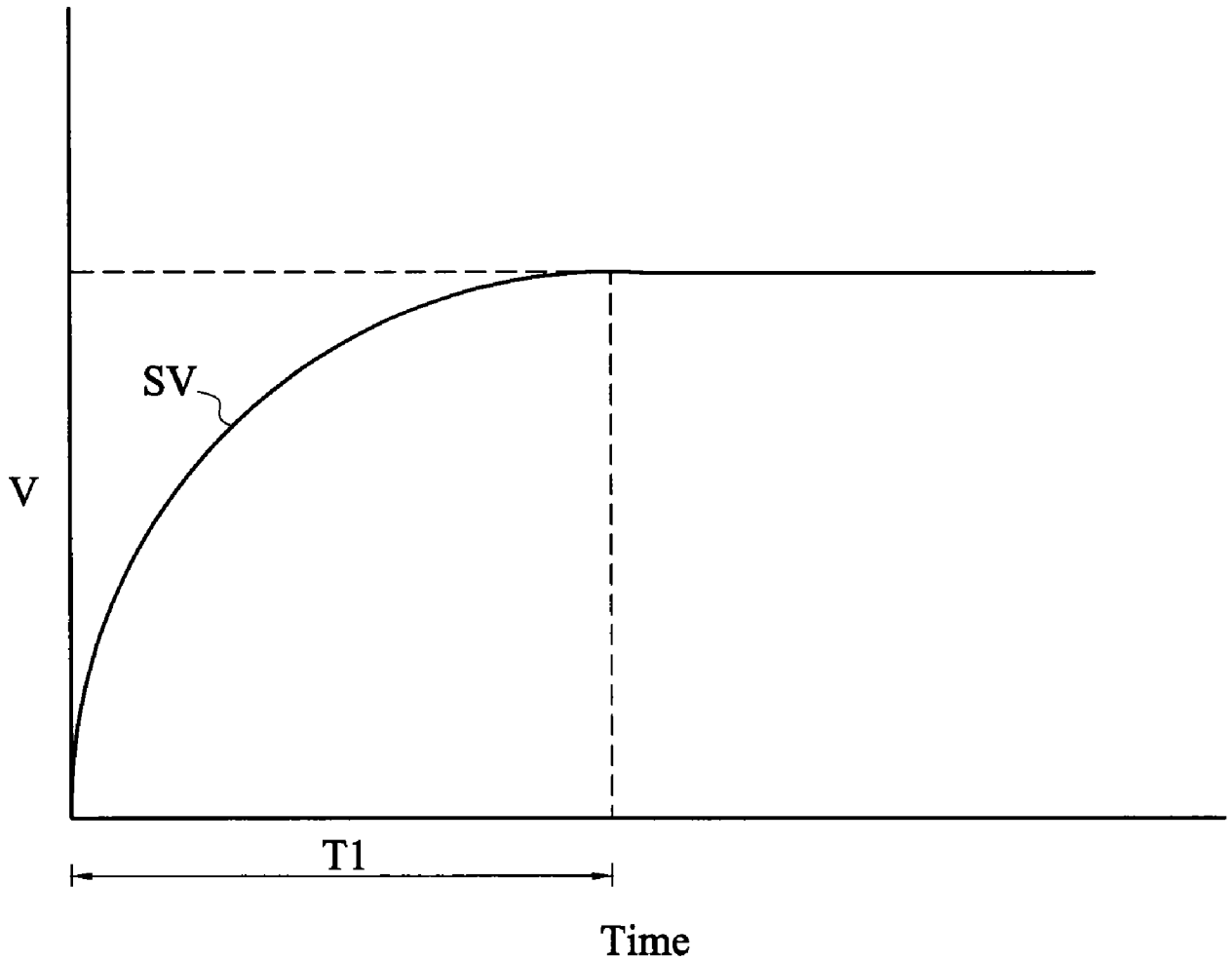
FIG. 5A shows the voltage variation of the first capacitor C1 when the ambient light intensity is decreased.

When the ambient light intensity is decreased, the light sensor accordingly outputs a decreased current signal to the RC circuit. The current signal passes the first resistor R1 to generate a decreased voltage to charge the first capacitor C1, thus, the first capacitor C1 requires increased time to reach a saturation voltage. FIG. 5A shows the voltage variation of the first capacitor C1 when the ambient light intensity is decreased, wherein the voltage signal SV of the first capacitor C1 shows the time T1 required to reach the saturation voltage thereof, and the curve shows the voltage signal SV with regular variation period.

Figure 5B:
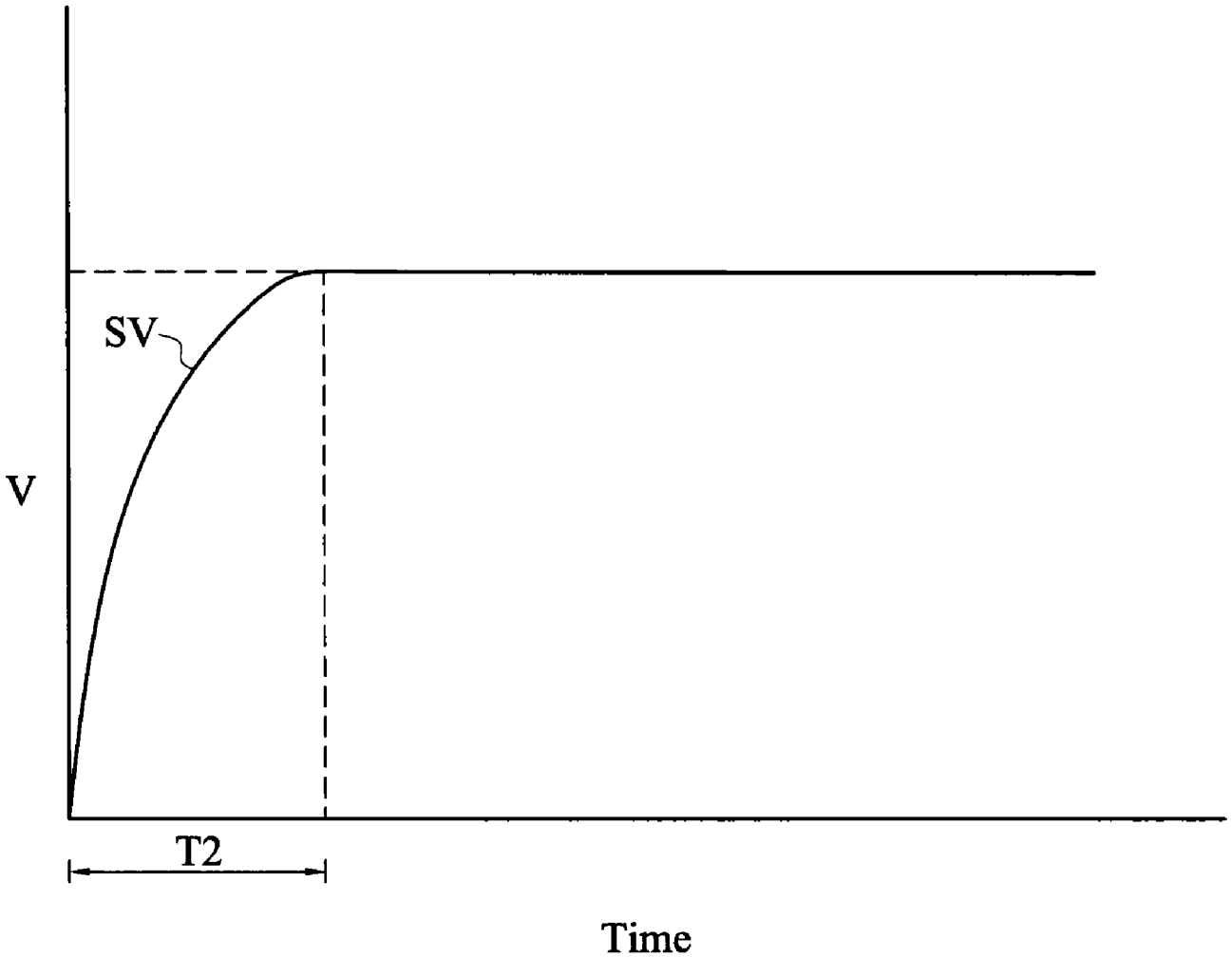
FIG. 5B shows the voltage variation of the first capacitor C1 when the ambient light intensity is increased.

When the ambient light intensity is increased, the light sensor accordingly outputs an increased current signal to the RC circuit. The current signal passes the first resistor R1 to generate an increased voltage to charge the first capacitor C1, and the first capacitor C1 requires less time to reach a saturation voltage. FIG. 5B shows the voltage variation of the first capacitor C1 when the ambient light intensity is increased, wherein the voltage signal SV of the first capacitor C1 shows the time T2 required to reach the saturation voltage thereof, and the curve shows the voltage signal SV with regular variation period.

Figure 6A:
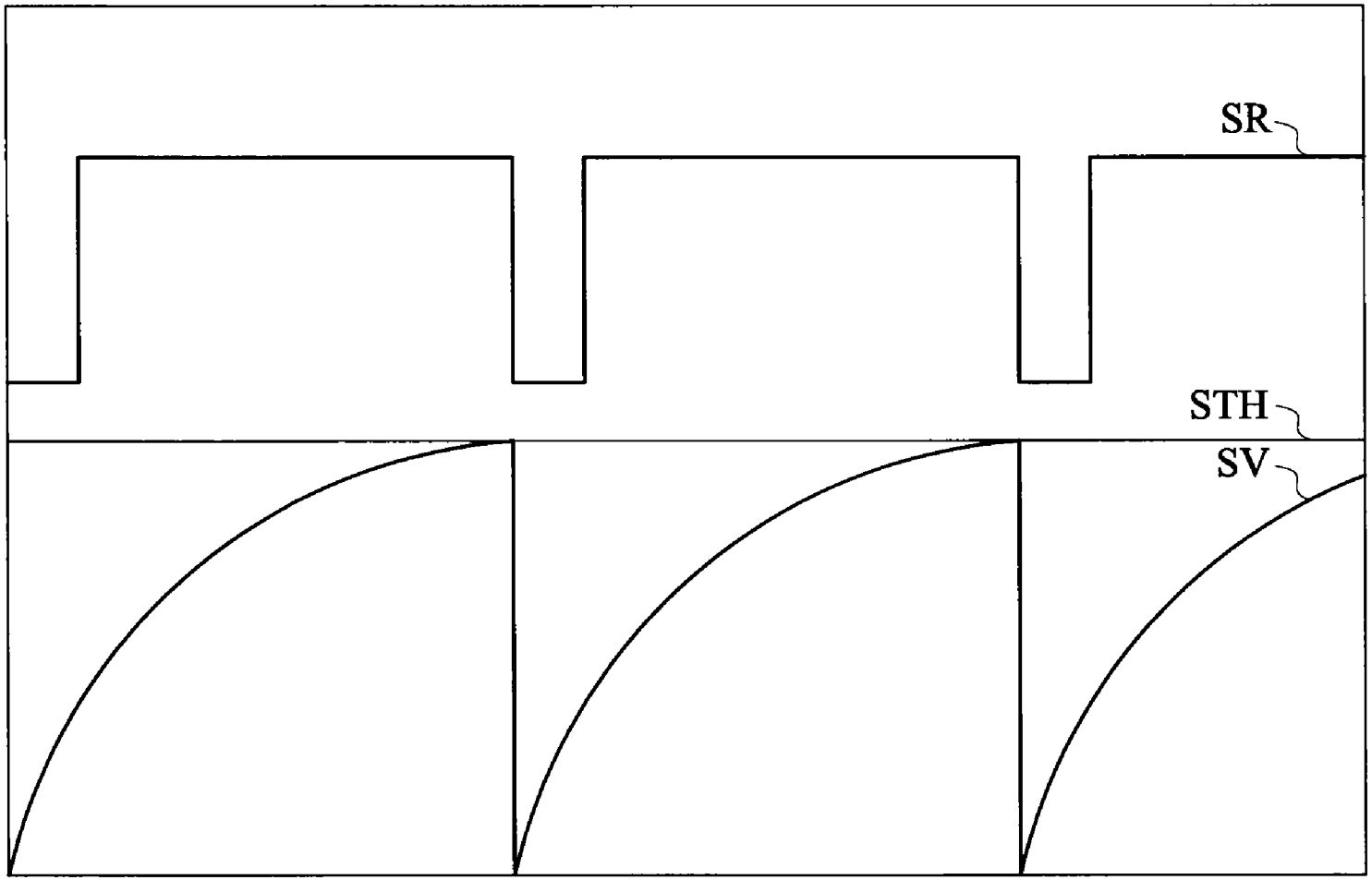
FIG. 6A shows the comparison result of the comparator under a darker environment.
Figure 6B:
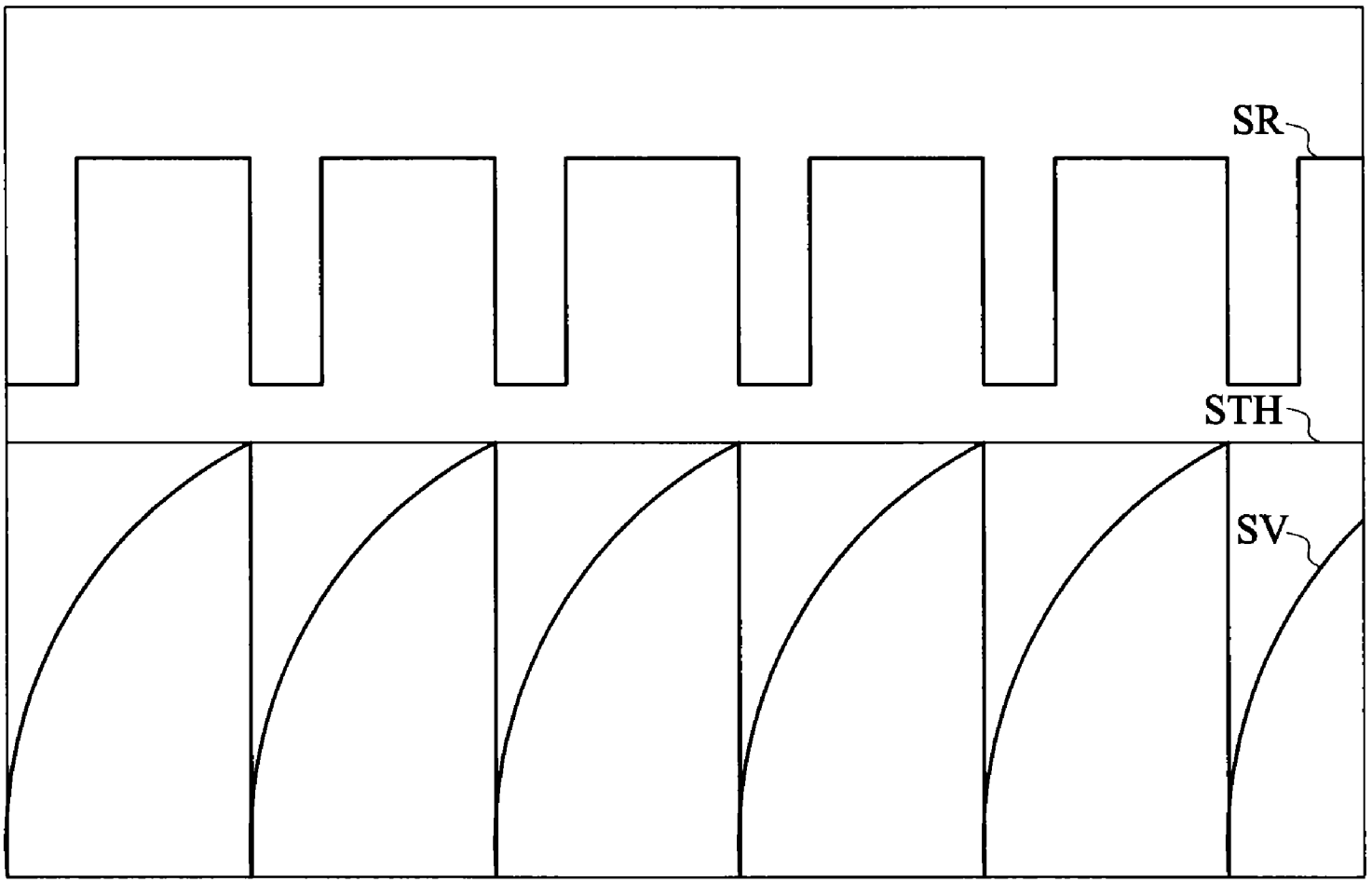
FIG. 6B shows the comparison result of the comparator under a brighter environment.

The input voltage variations at the signal input terminal of the comparator 3031 are shown in FIGS. 5A and 5B. The threshold value voltage inputted to the threshold value input terminal of the comparator 3031 is constant. The comparison result of the comparator 3031 of the signal input terminal and the threshold value input terminal under dark and bright environments are shown in FIGS. 6A and 6B. FIG. 6A shows the comparison result of the comparator 3031 under a darker environment, and FIG. 6B shows the comparison result of the comparator 3031 under a brighter environment. When the voltage output terminal Vout of the comparator 3031 outputs low level voltage, the voltage stored in the first capacitor C1 (grounded) is immediately discharged. After discharging, the voltage signal SV is lower then the threshold value voltage, the voltage output terminal Vout of the comparator 3031 outputs a high level voltage and the first capacitor C1 is charged again. When the threshold value voltage is fixed, with a longer regular period T1, the voltage signal SV requires a longer time to exceed the threshold value voltage to make the voltage output terminal Vout of the comparator 3031 output the low level voltage. With a shorter regular period T2, the voltage signal SV requires a shorter time to exceed the threshold value voltage to make the voltage output terminal Vout of the comparator 3031 output the low level voltage.

When the voltage output terminal Vout of the comparator 3031 outputs the high level voltage, the PNP transistor is disabled, and the LED is disabled. When the voltage output terminal Vout of the comparator 3031 outputs the low level voltage, the LED is enabled. As shown in FIGS. 5A and 5B, the voltage level of the voltage output terminal Vout controls the activity of the LED. Note that changes in the voltage level are in fast frequencies, thus, when the PNP transistor outputs a high level voltage, the user is still under the impression that the LED is enabled due to the visual staying phenomenon. The light intensity of the LED is controlled by the speed in which the frequencies of the voltage level changes. As shown in FIG. 6A, when the period of the low level voltage is increased, the enable frequency of the PNP transistor is reduced, and the light intensity of the LED is decreased. As shown in FIG. 6B, when the period of the low level voltage is decreased, the enable frequency of the PNP transistor is increased, and the light intensity of the LED is increased.

Another embodiment of the invention provides an aiming device, comprising an auto light intensity adjustment system 30, power source device 701 and a target marking portion 704. The power source device 701 provides power source VCC to the auto light intensity adjustment system 30. The target marking portion 704 comprises a target mark 7041, wherein the target mark 7041 is illuminated by a light emitted from the auto light intensity adjustment system 30.

The auto light intensity adjustment system 30 comprises a light sensing unit 301, a charge/discharge circuit 302, a comparator unit 303 and a light source module 304. The light sensing unit 301 outputs a sensing signal S1 according to the ambient light intensity detected thereby. The charge/discharge circuit 302 is coupled to the light sensing unit 301 for receiving the sensing signal S1, and generating a voltage signal SV with regular variation periods according to the sensing signal S1. The comparator unit 303 comprises a threshold value circuit 3032 and a comparator 3031. The threshold value circuit 3032 generates a threshold value signal STH. The comparator 3031 is coupled to the charge/discharge circuit 302 and the threshold value circuit 3032 for comparing the voltage signal SV to the threshold value signal STH and outputting a result signal SR accordingly. The light source module 304 comprises a control circuit 3041 and a lighting element 3042. The control circuit 3041 controls an enable frequency of the lighting element 3042 according to the result signal SR to control the lighting intensity of the lighting element 3042.

The power source device 701 provides the power source VCC to the auto light intensity adjustment system 30.

The target marking portion 704 comprises the target mark 7041, which reflects the light provided by the auto light intensity adjustment system 30 to light the target mark 7041. The target mark 7041 can be a circular spot or a hairline.

Figure 7:
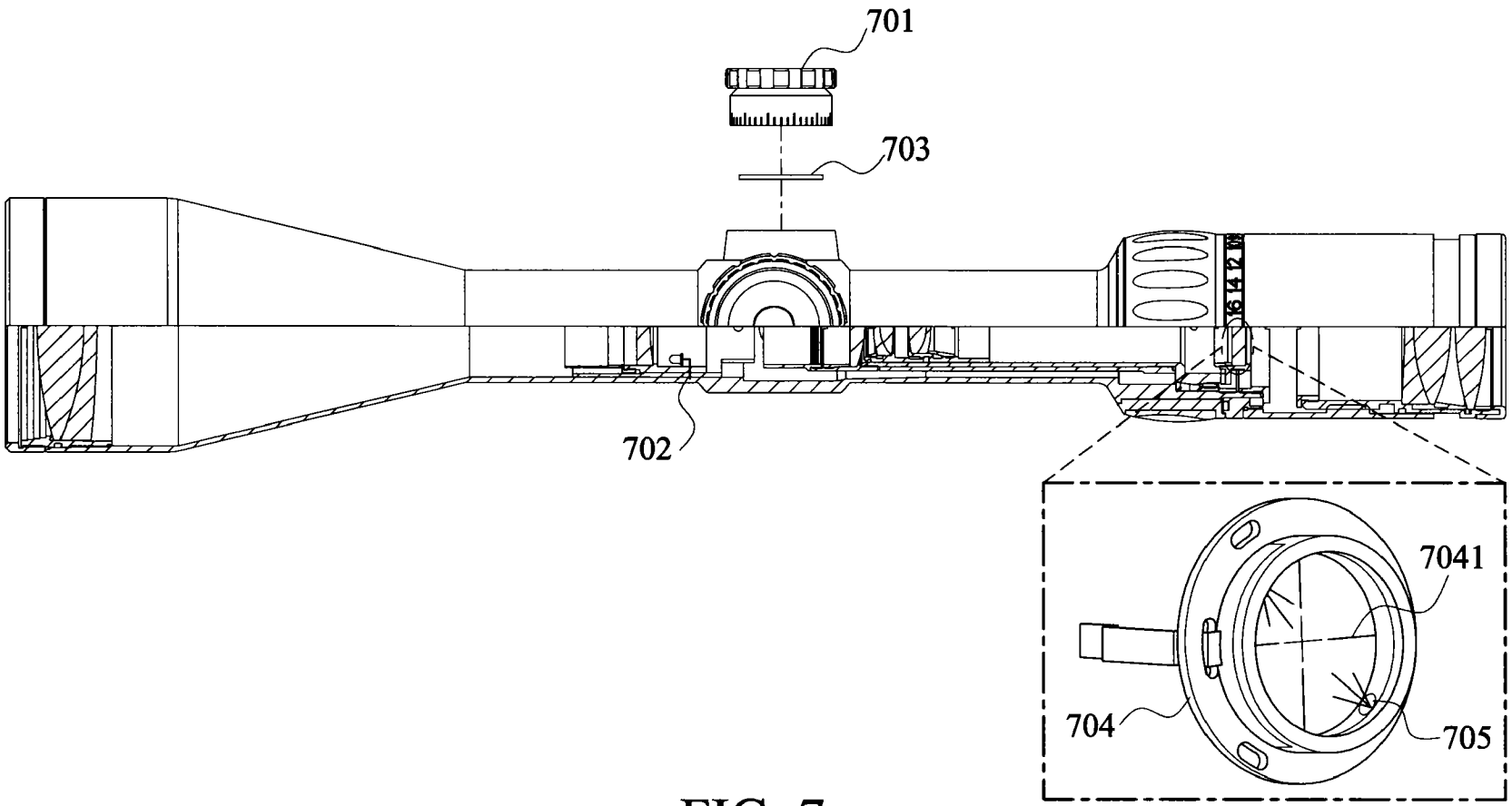
FIG. 7 shows the aiming device utilizing the embodiment of a light intensity adjustment system of the invention.

FIG. 7 shows the aiming device utilizing the embodiment of a light intensity adjustment system of the invention. The power source device 701, such as a battery, provides the power source VCC to the auto light intensity adjustment system 30. The sensing unit 301 is disposed on a light path of the light traveling in the aiming device to sense ambient light intensity and to control the lighting intensity of the light source module 304. In the embodiment, the sensing unit 301 is a light sensor 702. In another embodiment, the sensing unit 301 can be any element that generates signals according to the sensing of light intensity.

The light source module 304 is a light emitting diode 705, which does not restrict the invention thereto. Additionally, the sensing unit 301 can be disposed in any position on the aiming device where the environment light can be sensed.

In the embodiment, the charge/discharge circuit 302 and the comparator unit 303 are incorporated into a circuit board 703. The circuit board 703 is disposed bellow the power source device 701. In other embodiments, the circuit board 703 can be disposed in any other position of the aiming device according to space or position considerations.

In the embodiment, the target marking portion 704 is a transparent glass and the target mark (hairline) 7041 is formed on the transparent glass by an etching process. When the light emitting diode 705 surrounds the transparent glass and emits light, the target mark (hairline) 7041 is lighted. The target mark 7041 can be circular spot. In other embodiments, the target mark 7041 can be formed by coating a reflective material on the transparent glass.

When the light sensor 702 is under a bright environment, the light sensor 702 sends the signal to the charge/discharge circuit 302 and the comparator unit 303 of the circuit board 703, and the light intensity of the light emitting diode 705 is increased according to the result signal SR to make the target mark 7041 brighter. When the light sensor 702 is under a dark environment, the light sensor 702 sends the signal to the charge/discharge circuit 302 and the comparator unit 303 of the circuit board 703, and the light intensity of the light emitting diode 705 is decreased according to the result signal SR to make the target mark 7041 darker. Therefore, the brightness of the target mark 7041 of the target marking portion 704 is immediately modified according to the ambient light intensity.

The invention generates sensing signals S1 according to ambient light intensity sensed by the sensing unit 301. Different sensing signals S1 cause different charging times of the charge/discharge circuit 302 and the frequency of the result signal SR outputted from the comparator 3031 is thus changed, the lighting frequency of the light source module 304 is controlled, and the lighting intensity is increased or decreased. Utilizing the aiming device of the invention, the aiming device can modify automatically brightness of a target mark according to the ambient light intensity. Therefore, the user can focus on a target under any ambient light intensity change rather than manually modifying brightness of the target mark, and taking aim away from the target.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An aiming device, comprising:

an auto light intensity adjustment system, modifying a lighting intensity according to an ambient light intensity detected thereby, wherein the auto light intensity adjustment system comprises:

a light sensing unit, outputting a sensing signal according to the ambient light intensity detected thereby;

a charge/discharge circuit, coupled to the light sensing unit for receiving the sensing signal, and generating a voltage signal with regular variation periods according to the sensing signal;

a comparator unit, comparing the voltage signal to a threshold value signal, and outputting a result signal accordingly; and a light source module, modifying the lighting intensity according to the result signal;

a power source, providing power to the auto light intensity adjustment system; and a target marking portion, comprising a target mark, wherein the target mark is illuminated by a light emitted from the auto light intensity adjustment system.

2. The aiming device as claimed in claim 1, wherein the comparator unit comprises:

a threshold value circuit, generating the threshold value signal; and a comparator, coupled to the charge/discharge circuit for comparing the voltage signal to the threshold value signal and outputting the result signal accordingly.

3. The aiming device as claimed in claim 1, wherein the light source module comprises:

a control circuit; and a lighting element, wherein the control circuit controls an enable frequency of the lighting element according to the result signal to control the lighting intensity of the lighting element.

4. The aiming device as claimed in claim 1, wherein the charge/discharge circuit is an RC circuit comprising a first resistor and a first capacitor, the sensing signal passes the first resistor to vary a charging time of the first capacitor, and the first capacitor generates the voltage signal with regular variation periods.

5. The aiming device as claimed in claim 1, wherein the sensing unit is disposed on a light path of the light traveling in the aiming device.

6. The aiming device as claimed in claim 1, wherein the light sensing unit comprises a light sensor.

7. The aiming device as claimed in claim 1, wherein the charge/discharge circuit and the comparator unit are incorporated on a circuit board.

8. The aiming device as claimed in claim 1, wherein the target marking portion is a transparent glass, and the target mark is etched thereon.

9. The aiming device as claimed in claim 1, wherein the target mark is formed by reflective material.

10. The aiming device as claimed in claim 1, wherein the light source module is disposed surrounding the target marking portion.

* * * * *